US008663894B1

(12) United States Patent
Asarese

(10) Patent No.: US 8,663,894 B1
(45) Date of Patent: Mar. 4, 2014

(54) METHOD TO ADJUST THE MELT FLOW INDEX OF A TONER

(75) Inventor: Daniel W. Asarese, Honeoye Falls, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/598,400

(22) Filed: Aug. 29, 2012

(51) Int. Cl.
*G03G 9/08* (2006.01)

(52) U.S. Cl.
USPC ..... 430/137.14; 430/137.1

(58) Field of Classification Search
USPC ..... 430/137.14, 137.1
See application file for complete search history.

(56) References Cited

U.S. PATENT DOCUMENTS

| | | | | |
|---|---|---|---|---|
| 5,227,460 | A | 7/1993 | Mahabadi et al. | |
| 5,346,797 | A | 9/1994 | Kmiecik-Lawrynowicz et al. | |
| 5,364,729 | A | 11/1994 | Kmiecik-Lawrynowicz et al. | |
| 5,403,693 | A | 4/1995 | Patel et al. | |
| 5,418,108 | A | 5/1995 | Kmiecik-Lawrynowicz et al. | |
| 5,501,935 | A | 3/1996 | Patel et al. | |
| 5,527,658 | A | 6/1996 | Hopper et al. | |
| 5,585,215 | A | 12/1996 | Ong et al. | |
| 5,650,225 | A | 7/1997 | Dutta et al. | |
| 5,650,256 | A | 7/1997 | Veregin et al. | |
| 6,593,049 | B1 | 7/2003 | Veregin et al. | |
| 6,756,176 | B2 | 6/2004 | Stegamat et al. | |
| 6,830,860 | B2 | 12/2004 | Sacripante et al. | |
| 7,906,264 | B2 * | 3/2011 | Takahashi et al. | 430/109.4 |
| 2011/0086304 | A1 | 4/2011 | Asarese et al. | |
| 2012/0225382 | A1 * | 9/2012 | Hwang et al. | 430/137.14 |

FOREIGN PATENT DOCUMENTS

| | | | |
|---|---|---|---|
| WO | WO-2011/074902 | A2 * | 6/2011 |

* cited by examiner

*Primary Examiner* — Janis L Dote
(74) *Attorney, Agent, or Firm* — Oliff PLC

(57) ABSTRACT

Method of adjusting the melt flow index of a toner is described, the method including adjusting the pH of the toner after the toner particles have been coalesced and the adjusting alters the melt flow index of the toner.

16 Claims, 1 Drawing Sheet

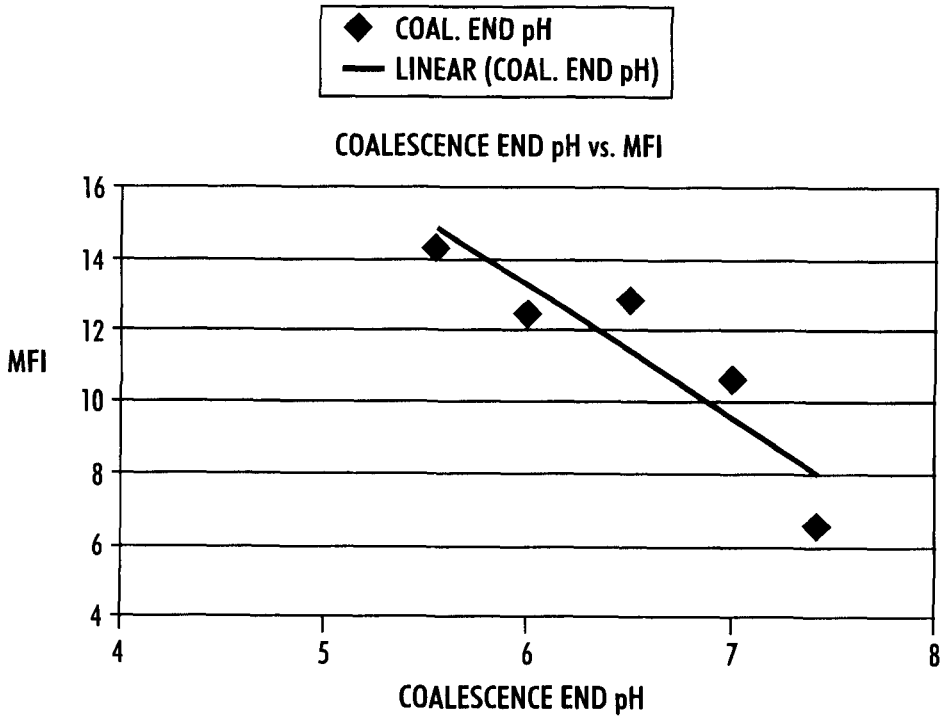
COAL. END pH
LINEAR (COAL. END pH)
COALESCENCE END pH vs. MFI
MFI
16
14
12
10
8
6
4
4
5
6
7
8
COALESCENCE END pH

METHOD TO ADJUST THE MELT FLOW INDEX OF A TONER

BACKGROUND

The present disclosure relates to a novel method to adjust the melt flow index (MFI) of a toner by pH adjustment.

The melt flow index (MFI) of a toner is a measurement of the flow of the toner when it is in the fluid state. It is also a surrogate measurement of viscosity and elasticity used in the manufacturing environment. The flow of a toner is an important property because it drives the interaction between the toner and the fusing subsystem components of printers and xerographic devices. If the MFI of the toner is not within specification, the image quality can suffer due to defects such as spots, streaks and smudges. These defects can be the result of the toner not adhering enough to the substrate, toner not melting completely, toner sticking to the fuser roll, and also excessive contamination of the cleaning web.

It has been believed that the MFI of an emulsion aggregation (EA) parent particle is dictated by the formulation of that particle and that the variability of that MFI is due largely to the variation of the raw materials. This variability leads to either very wide specifications that test or exceed the boundaries of machine performance (fusing, Additive Adhesion Force Disruption, which measures how well external additives are attached to the particle, aging) and blocking. If the specification limits are not wide enough, this leads to increased testing, increased inventory during testing, and increased product loss. So far, the control of the MFI of a toner is done by setting specifications for raw materials properties, in particular the latex. Some of the key latex properties that drive the MFI include molecular weight, glass transition temperature, and also the crosslinking density. In addition, the MFI of a toner may be adjusted by altering the amount of flocculent in the particle formation process. However, these strategies can lead to raw material specifications that may be difficult to meet, and can also lead to changes in process outputs such as coarse generation and aggregation rate.

There remains a need to be able to control and adjust the MFI of a toner that reduces the variability while limiting the amount of testing and product loss.

Numerous processes are within the purview of those skilled in the art for the preparation of toners. Emulsion aggregation is one such method. These toners are within the purview of those skilled in the art and toners may be formed by aggregating a colorant with a latex polymer formed by emulsion polymerization. For example, U.S. Pat. No. 5,853,943, the disclosure of which is hereby incorporated by reference in its entirety, is directed to a semi-continuous emulsion polymerization process for preparing a latex by first forming a seed polymer. Other examples of emulsion/aggregation/coalescing processes for the preparation of toners are illustrated in U.S. Pat. Nos. 5,403,693, 5,418,108, 5,364,729 and 5,346,797, the disclosures of each of which are hereby incorporated by reference in their entirety. Other processes are disclosed in U.S. Pat. Nos. 5,527,658, 5,585,215, 5,650,255, 5,650,256 and 5,501,935, the disclosures of each of which are hereby incorporated by reference in their entirety.

Improved methods for producing toner, which decrease the production time and permit excellent control of the charging of toner particles, remain desirable.

SUMMARY

A method for adjusting the melt flow index of a toner particle, is disclosed, wherein the method includes adjusting a pH of the toner particle after a coalescing of the toner particle.

In another aspect of the present disclosure, a method is disclosed wherein the method includes aggregating a mixture comprising a latex binder, coalescing the aggregated particles, and adjusting a pH of the coalesced toner particles.

A process is also described, wherein the process includes preparing an emulsion comprising at least one polymer, at least one surfactant, and an optional colorant, aggregating the emulsion with an aggregating agent to form aggregated particles, coalescing the aggregated particles by heating to fix a shape of the particles, and adjusting a pH of the coalesced particles.

BRIEF DESCRIPTION OF THE DRAWING

FIG. 1 is a graph depicting the correlation of the MFI to pH of an example toner.

EMBODIMENTS

As used herein, the modifier, "about," used in connection with a quantity is inclusive of the stated value and has the meaning dictated by the context (for example, it includes at least the degree of error associated with the measurement of the particular quantity). When used in the context of a range, the modifier, "about," should also be considered as disclosing the range defined by the absolute values of the two endpoints. For example, the range, "from about 2 to about 4," also discloses the range, "from 2 to 4."

The present disclosure provides a process for adjusting the melt flow index (MFI) of a toner.

The toners of the present disclosure may be prepared by combining a latex polymer binder, an optional wax, a colorant, and other optional additives.

While the latex polymer may be prepared by any method within the purview of those skilled in the art, the latex polymer may, for example, be prepared by emulsion polymerization methods, for example, semi-continuous emulsion polymerization. The latex may then be used to prepare a toner, for example, by emulsion aggregation methods. Emulsion aggregation involves aggregation of the latex polymer into larger size particles. Toners can be prepared by emulsion aggregation where a colorant is included with the latex polymer to be subjected to aggregation.

Any monomer suitable for preparing a latex for use in a toner may be utilized. As noted above, the toner may be produced by, for example, emulsion aggregation (EA).

Suitable monomers useful in forming a latex polymer emulsion, and thus the resulting latex particles in the latex emulsion, include, for example, styrenes, acrylates, methacrylates, butadienes, isoprenes, acrylic acids, methacrylic acids, acrylonitriles, combinations thereof, and the like.

The latex polymer may include a single polymer or may be a mixture of polymers. Polymers include, for example, styrene acrylates, styrene butadienes, styrene methacrylates, and more specifically, poly(styrene-alkyl acrylate), poly(styrene-1,3-diene), poly(styrene-alkyl methacrylate), poly(styrene-alkyl acrylate-acrylic acid), poly(styrene-1,3-diene-acrylic acid), poly(styrene-alkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile-acrylic acid), poly(styrene-1,3-diene-acrylonitrile-acrylic acid), poly(alkyl acrylate-acrylonitrile-acrylic acid), poly(styrene-butadiene), poly(methylstyrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly (styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene), poly(styrene-propyl acrylate), poly(styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylononitrile), poly(styrene-butyl acrylate-acrylonitrile-acrylic acid), poly(styrene-butadiene), poly(styrene-isoprene), poly (styrene-butyl methacrylate), poly(styrene-butyl acrylate-acrylic acid), poly(styrene-butyl methacrylate-acrylic acid), poly(butyl methacrylate-butyl acrylate), poly(butyl methacrylate-acrylic acid), poly(acrylonitrile-butyl acrylate-acrylic acid), and combinations thereof. The polymers may be block, random, or alternating copolymers.

In addition, polyester resins may also be used to form a latex polymer. The polyester resin may be in addition to the latex polymers described above, or substituted for the latex polymer.

Any polyester resin may be utilized in making polyester latexes. The resin may be an amorphous resin, a crystalline resin, and/or a combination thereof. The resin may be a polyester resin, such as described in U.S. Pat. Nos. 6,593,049 and 6,756,176, the disclosures of each of which are hereby incorporated by reference in their entirety. Suitable resins may also include a mixture of an amorphous polyester resin and a crystalline polyester resin as described in U.S. Pat. No. 6,830,860, the disclosure of which is hereby incorporated by reference in its entirety.

For example, the polyester resin may be obtained from the reaction products of bisphenol A and propylene oxide or propylene carbonate, as well as the polyesters obtained by reacting those reaction products with fumaric acid, for example, as disclosed in U.S. Pat. No. 5,227,460, the entire disclosure of which is incorporated herein by reference, and branched polyester resins resulting from the reaction of dimethylterephthalate with 1,3-butanediol, 1,2-propanediol, and pentaerythritol.

If the polymer is not formed as an emulsion, the EA process requires polymers to be first formulated into latex emulsions, for example, by solvent containing batch processes, such as solvent flash emulsification and/or solvent-based phase inversion emulsification.

The latex may be prepared with a surfactant or co-surfactant. Surfactants that may be utilized with the polymer to form a latex dispersion can be ionic or nonionic surfactants in an amount suitable to provide a dispersion of from about 0.01 to about 15 weight percent solids, in embodiments of from about 0.1 to about 10 weight percent solids.

Anionic surfactants which may be utilized include sulfates and sulfonates, sodium dodecylsulfate (SDS), sodium dodecylbenzene sulfonate, sodium dodecylnaphthalene sulfate, dialkyl benzenealkyl sulfates and sulfonates, acids such as abietic acid available from Aldrich, NEOGEN R™, NEOGEN SC™ obtained from Daiichi Kogyo Seiyaku Co., Ltd., DOWFAX™ obtained from Dow Chemical, combinations thereof, and the like.

Examples of cationic surfactants include ammoniums, for example, alkylbenzyl dimethyl ammonium chloride, dialkyl benzenealkyl ammonium chloride, lauryl trimethyl ammonium chloride, alkylbenzyl methyl ammonium chloride, alkyl benzyl dimethyl ammonium bromide, benzalkonium chloride, C12, C15, C17 trimethyl ammonium bromides, combinations thereof, and the like. Other cationic surfactants include cetyl pyridinium bromide, halide salts of quaternized polyoxyethylalkylamines, dodecylbenzyl triethyl ammonium chloride, MIRAPOL and ALKAQUAT available from Alkaril Chemical Company, SANISOL (benzalkonium chloride), available from Kao Chemicals, combinations thereof, and the like. In addition, suitable cationic surfactant includes SANISOL B-50 available from Kao Corp., which is primarily a benzyl dimethyl alkonium chloride.

Examples of nonionic surfactants include alcohols, acids and ethers, for example, polyvinyl alcohol, polyacrylic acid, methalose, methyl cellulose, ethyl cellulose, propyl cellulose, hydroxyl ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy) ethanol, combinations thereof, and the like. In addition, commercially available surfactants may be used, for example, surfactants from Rhone-Poulenc such as IGEPAL CA210™, IGEPAL CA520™, IGEPAL CA720™, IGEPAL CO890™, IGEPAL CO720™, IGEPAL CO290™, IGEPAL CA210™, ANTAROX 890™ and ANTAROX 897™ can be utilized.

The choice of particular surfactants or combinations thereof, as well as the amounts of each to be used, are within the purview of those skilled in the art.

Initiators may be added for formation of the latex polymer. Examples of suitable initiators include water soluble initiators, such as ammonium persulfate, sodium persulfate and potassium persulfate, and organic soluble initiators including organic peroxides and azo compounds including Vazo peroxides, such as VAZO 64™, 2-methyl 2-2'-azobis propanenitrile, VAZO 88™, 2-2'-azobis isobutyramide dehydrate, and combinations thereof. Other water-soluble initiators which may be utilized include azoamidine compounds, for example 2,2'-azobis(2-methyl-N-phenylpropionamidine)dihydrochloride, 2,2'-azobis[N-(4-chlorophenyl)-2-methylpropionamidine]di-hydrochloride, 2,2'-azobis[N-(4-hydroxyphenyl)-2-methyl-propionamidine]dihydrochloride, 2,2'-azobis[N-(4-amino-phenyl)-2-methylpropionamidine] tetrahydrochloride, 2,2'-azobis[2-methyl-N(phenylmethyl) propionamidine]dihydrochloride, 2,2'-azobis[2-methyl-N-2-propenylpropionamidine]dihydrochloride, 2,2'-azobis[N-(2-hydroxy-ethyl)-2-methylpropionamidine]dihydrochloride, 2,2'-azobis[2(5-methyl-2-imidazolin-2-yl)propane]dihydrochloride, 2,2'-azobis[2-(2-imidazolin-2-yl)propane]dihydrochloride, 2,2'-azobis[2-(4,5,6,7-tetrahydro-1H-1,3-diazepin-2-yl)propane]dihydrochloride, 2,2'-azobis[2-(3,4,5,6-tetrahydropyrimidin-2-yl)propane]dihydrochloride, 2,2'-azobis[2-(5-hydroxy-3,4,5,6-tetrahydropyrimidin-2-yl) propane]dihydrochloride, 2,2'-azobis{2-[1-(2-hydroxyethyl)-2-imidazolin-2-yl]propane}dihydrochloride, combinations thereof, and the like.

Initiators may be added in any suitable amount, for example, from about 0.1 to about 8 weight percent of the monomers, or from about 0.2 to about 5 weight percent of the monomers.

Chain transfer agents may also be utilized in forming the latex polymer. Suitable chain transfer agents include dodecane thiol, octane thiol, carbon tetrabromide, and the like, or combinations thereof. The charge transfer agents may be added in any suitable amount, for example in amounts ranging from about 0.1 to about 10 percent, or from about 0.2 to about 5 percent by weight of monomers. The charge transfer agents control the molecular weight properties of the latex polymer when emulsion polymerization is conducted.

A gel latex may be added to the non-crosslinked latex resin suspended in the surfactant. A gel latex may refer to, for example, a latex containing crosslinked resin or polymer, or mixtures thereof, or a non-crosslinked resin as described above, that has been subjected to crosslinking.

The gel latex may include submicron crosslinked resin particles having a size of from about 10 to about 200 nanometers in volume average diameter, such as from about 20 to 100 nanometers in volume average diameter. The gel latex may be suspended in an aqueous phase of water containing a surfactant, wherein the surfactant can be in an amount from about 0.5 to about 5 percent by weight of total solids, or from about 0.7 to about 2 percent by weight of total solids.

The crosslinked resin may be a crosslinked polymer such as crosslinked styrene acrylates, styrene butadienes, and/or styrene methacrylates. In particular, exemplary crosslinked resins are crosslinked poly(styrene-alkyl acrylate), poly(styrene-butadiene), poly(styrene-isoprene), poly(styrene-alkyl methacrylate), poly(styrene-alkyl acrylate-acrylic acid), poly (styrene-butadiene-acrylic acid), poly(styrene-isoprene-acrylic acid), poly(styrenealkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile acrylic acid), crosslinked poly (alkyl acrylate-acrylonitrile-acrylic acid), and mixtures thereof.

A crosslinker, such as divinyl benzene or other divinyl aromatic or divinyl acrylate or methacrylate monomers, may be used in crosslinking the polymer. The crosslinker may be present in an amount of from about 0.01 to about 25 percent by weight of the crosslinked resin, such as from about 0.5 to about 15 percent by weight of the polymer.

The crosslinked resin particles may be present in an amount of from about 1 to about 20 percent by weight of the toner, in embodiments from about 4 to about 15 percent by weight of the toner, in embodiments from about 5 to about 14 percent by weight of the toner.

The resin utilized to form the toner may be a mixture of a gel resin and a non-crosslinked resin.

A functional monomer may be added when forming a latex polymer and the particles making up the polymer. Functional monomers may include monomers having carboxylic acid functionality. Such functional monomers may be of the following formula (I):

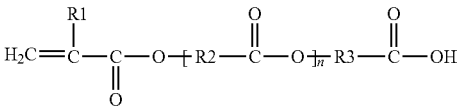

(I)

where R1 is hydrogen or a methyl group; R2 and R3 are independently selected from alkyl groups containing from about 1 to about 12 carbon atoms or a phenyl group; n is from about 0 to about 20, in embodiments from about 1 to about 10. Examples of such functional monomers include beta carboxyethyl acrylate (β-CEA), poly(2-carboxyethyl) acrylate, 2-carboxyethyl methacrylate, combinations thereof, and the like. Other functional monomers which may be utilized include, for example, acrylic acid and its derivatives.

The functional monomer having carboxylic acid functionality may also contain a small amount of metallic ions, such as sodium, potassium and/or calcium, to achieve better emulsion polymerization results. The metallic ions may be present in any suitable amount. For example, the metallic ions may be in an amount ranging from about 0.001 to about 10 percent by weight of the functional monomer having carboxylic acid functionality, or from about 0.5 to about 5 percent by weight of the functional monomer having carboxylic acid functionality.

The functional monomer may be added in amounts from about 0.01 to about 5 percent by weight of the toner, such as from about 0.05 to about 2 percent by weight of the toner.

In the emulsion polymerization process, the reactants may be added to a suitable reactor, such as a mixing vessel. The appropriate amount of at least two monomers, for example, from one to about ten monomers, surfactant(s), functional monomer, if any, initiator, if any, chain transfer agent if any, and the like, may be combined in the reactor and the emulsion polymerization process may be initiated. Reaction conditions selected for effecting the emulsion polymerization include temperatures of, for example, from about 45° C. to about 120° C., such as from about 60° C. to about 90° C.

Polymerization may be continued until nanometer size particles are formed. For example, the particles may be from about 40 nm to about 800 nm in volume average diameter, from about 100 nm to about 400 nm in volume average diameter as determined, for example, by a Microtrac UPA150 particle size analyzer.

After creation of the latex containing nanometer sized particles, other materials may be added to the latex in order to create a toner. After addition of the other materials, the mixture is subjected to an aggregation step in order to create toner particles.

In some embodiments a pH adjustment agent may be added to control the rate of the emulsion aggregation process. The pH adjustment agent utilized in the processes of the present disclosure can be any acid or base that does not adversely affect the products being produced. Suitable bases can include metal hydroxides, such as sodium hydroxide, potassium hydroxide, ammonium hydroxide, and optionally combinations thereof. Suitable acids include nitric acid, sulfuric acid, hydrochloric acid, citric acid, acetic acid, and optionally combinations thereof.

Wax dispersions may be added during formation of a toner particle in an emulsion aggregation process. Suitable waxes include, for example, submicron wax particles in the size range of from about 50 to about 1000 nm, from about 100 to about 500 nm in volume average diameter suspended in an aqueous phase of water and an ionic surfactant, nonionic surfactant, or combinations thereof. Suitable surfactants include those described above. The ionic surfactant or nonionic surfactant may be present in an amount ranging from about 0.1 to about 20 percent by weight, from about 0.5 to about 15 percent by weight of the wax.

The wax dispersion may include, for example, a natural vegetable wax, natural animal wax, mineral wax, synthetic wax. Examples of natural vegetable waxes include, for example, carnauba wax, candelilla wax, Japan wax, and bayberry wax. Examples of natural animal waxes include, for example, beeswax, punic wax, lanolin, lac wax, shellac wax, and spermaceti wax. Mineral waxes include, for example, paraffin wax, microcrystalline wax, montan wax, ozokerite wax, ceresin wax, petrolatum wax, and petroleum wax. Synthetic waxes of the present disclosure include, for example, Fischer-Tropsch wax, acrylate wax, fatty acid amide wax, silicone wax, polytetrafluoroethylene wax, polyethylene wax, polypropylene wax, or combinations thereof.

A colorant may be added in the mixture to be subjected to aggregation. Colorants useful in forming toners in accordance with the present disclosure include pigments, dyes, mixtures of pigments and dyes, mixtures of pigments, mixtures of dyes, and the like. The colorant may be, for example, carbon black, cyan, yellow, magenta, red, orange, brown, green, blue, violet, fluorescent colorants or combinations thereof.

As the colorant, a colorant dispersion may be used and may include, for example, submicron colorant particles having a size of, for example, from about 50 to about 500 nanometers in volume average diameter, from about 100 to about 400 nanometers in volume average diameter. The colorant particles may be suspended in an aqueous water phase containing an anionic surfactant, a nonionic surfactant, or combinations thereof. The surfactant may be ionic and may be from about 1 to about 25 percent by weight, from about 2 to about 15 percent by weight, or from about 3 to about 10 percent by weight of the colorant.

The colorant may be present in the toner in any suitable amount, for example from about 1 to about 25 percent by weight of toner, from about 2 to about 15 percent by weight of the toner or from about 3 to about 10 percent by weight of the toner.

An aggregating agent may be added during or prior to aggregating the latex.

Examples of aggregating agents include polyaluminum halides such as polyaluminum chloride (PAC), or the corresponding bromide, fluoride, or iodide, polyaluminum silicates such as polyaluminum sulfo silicate (PASS), and water soluble metal salts including aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate, and the like, or combinations thereof. The aggregating agent, for example, the polymetal salt, may be in a solution of nitric acid, or other diluted acid solutions such as sulfuric acid, hydrochloric acid, citric acid or acetic acid.

The aggregating agent may be added in any suitable amount. For example, the aggregating agent may be added to a concentration of from about 0.1 parts per hundred (pph) to about 0.25 pph, from about 0.12 pph to about 0.20 pph.

The resulting blend of latex, optionally in a dispersion, optional colorant, optional wax, and optional aggregating agent, may then be stirred and heated to a temperature near the glass transition temperature (Tg) of the latex resulting in toner aggregates of from about 3 microns to about 15 microns in volume average diameter, from about 3.5 microns to about 9 microns in volume average diameter, or from about 3.6 microns to about 8 microns. The blend may be heated, for example, from about 30° C. to about 70° C., such as 40° C. to about 65° C.

A pH adjustment agent may be added to control the rate of the emulsion aggregation process. The pH adjustment agent utilized in the processes of the present disclosure can be any acid or base that does not adversely affect the products being produced. Bases include, for example, metal hydroxides, such as sodium hydroxide, potassium hydroxide, ammonium hydroxide, or combinations thereof. Suitable acids include, for example, nitric acid, sulfuric acid, hydrochloric acid, citric acid, acetic acid, or combinations thereof.

While not required, a shell may be formed on the aggregated particles. Any latex utilized to form the core latex may also be utilized to form the shell latex. Following aggregation of initial particles, the additional latex is added and aggregation then continued, the added latex forming a shell upon the initial particles. A styrene-n-butyl acrylate copolymer may be utilized to form the shell latex. The latex utilized to form the shell may have a glass transition temperature of from about 35° C. to about 75° C., from about 40° C. to about 70° C. The shell may include a second non-crosslinked polymer, such as styrenes, acrylates, methacrylates, butadienes, isoprenes, acrylic acids, methacrylic acids, acrylonitriles, polyesters and the like, or combinations thereof.

The shell latex may also be applied by any other method within the purview of those skilled in the art, including dipping, spraying, and the like. The shell latex may be applied until the desired final size of the toner particles is achieved. For example, the final size may be from about 2 microns to about 12 microns, from about 3 microns to about 9 microns, or from about 3.5 microns to about 8 microns.

When present, the shell latex may be added in an amount of from about 20 to about 40 percent by weight of the dry toner particle, from about 26 to about 36 percent by weight of the dry toner particle.

Once the desired final size of the toner particles is achieved, the pH of the mixture may be adjusted with a base to a value of from about 3.5 to about 7, from about 4 to about 6.5. The base may include any suitable base such as, for example, alkali metal hydroxides such as, for example, sodium hydroxide, potassium hydroxide, and ammonium hydroxide. The alkali metal hydroxide may be added in amounts from about 0.1 to about 30 percent by weight of the mixture, from about 0.5 to about 15 percent by weight of the mixture. The adjustment of the pH in this step is to stop further aggregation and/or growth of the toner particles.

The mixture of latex and other optional additives described above may be subsequently coalesced. Coalescing melts the aggregated particles and reshapes the aggregated toner particles, for example, by increasing the circularity of and the smoothness of the aggregated particles.

Coalescing may include stirring and heating at a temperature of from about 60° C. to about 300° C., from about 60° C. to about 100° C., such as from about 80° C. to about 100° C., depending on the Tg and/or melting point of the polymer(s) of the binder. Coalescing may result in a toner shape, sometimes referred to as circularity, of from about 0.900 to about 0.999, from about 0.950 to about 0.998, or from about 0.955 to about 0.995. It is recognized that the reaction vessel the coalescing occurs in is desirably pressurized for aqueous based coalescence above 100° C.

Coalescing may be accelerated by adjusting the pH of the mixture to less than 7 with, for example, an acid to coalesce the toner aggregates.

Once the desired shape of the toner particles has been reached, and coalescing is complete, the pH of the mixture may be adjusted to change the MFI of the toner. The pH adjustment may occur at the coalescence temperature or at a temperature of about +/−40° C., or about +/−30° C., or about +/−20° C., from the coalescence temperature. However, in order for the pH adjustment to affect the MFI of the toner, the pH adjustment desirably occurs before the mixture is cooled to less than the Tg and/or melting point of the particle. Thus, the pH adjustment may occur at a temperature that is substantially the same as the coalescing temperature. The pH adjustment may occur after coalescing the toner particles, but before a removal of surfactants from a surface of the coalesced toner particles. In addition, as discussed above, it is recognized that if the reaction vessel is above 100° C., the reaction vessel is desirably pressurized.

In addition, the pH adjustment step here is separate from, and in addition to, any pH adjustment made during the EA and coalescing process steps, and in particular, is in addition to any pH adjustment to halt aggregation and any pH adjustment to accelerate coalescing. The pH adjustment here refers to a pH adjustment after coalescence.

In adjusting the MFI, the pH may be adjusted, for example, by the addition of a base or an acid. Any base may be used in accordance with the present disclosure. For example, suitable bases include both inorganic basic agents and organic basic agents. Suitable basic agents may include any bases described above. For example, a base may include ammonium hydroxide, potassium hydroxide, sodium hydroxide, sodium carbonate, sodium bicarbonate, lithium hydroxide, potassium carbonate, organoamines such as triethyl amine, and the like, or combinations thereof. In addition, any acid may be used in accordance with the present disclosure. For example, suitable acids include both inorganic acids agents and organic acid agents. For example, the acid may be hydrochloric acid, sulfuric acid, nitric acid, acetic acid, oxalic acid, lactic acid, citrates, combinations thereof, and the like.

The acid and/or base may be added in any amount necessary and in any form necessary to achieve the desired pH. For example, the acid and/or base may be added in the form of an aqueous solution or in solid form. The amount to add depends on the pH adjustment degree desired, which, as discussed below, depends on the amount of MFI adjustment desired. The desired MFI of a toner depends on the particular application, use of the toner, and instrument settings used to measure the MFI, which are known in the art. In addition, the desired pH depends on the desired MFI. As shown in FIG. 1, a lower pH results in a higher MFI.

The MFI is measured in an MFI measuring unit, for example, Tinius Olsen Model MP 987 Extrusion Plastometer (Melt Indexer). First a toner sample is dried, for example, by inserting a sample, for example 8 g of the toner into, for example Mettler-Toledo Model HR-73 Halogen Moisture Analyzer with balance. MFI is measured, by filling the sample tube in the measuring unit. The unit then applies a specified weight, for example 10 kg, at a specified temperature, for example, 130° C., to the dried sample. The applied weight forces the sample through a hole in the tube. The measuring unit then measures the amount of sample that flows through the hole in the tube over time.

For example, at an instrument setting of 130° C. and 10 kg of weight, at a pH of about 5, the MFI of a toner may be about 15, and for example, at a pH of about 8, the MFI of a toner may be about 5. However, a different MFI would be obtained at a different temperature and weight setting.

The method for adjusting the MFI of a toner may include, for example, determining the pH and/or MFI of the coalesced particles, comparing the measured pH and/or MFI to a desired and/or a predetermined pH and/or MFI for the toner, and then adding an acid to lower the pH of the coalesced particles in order to increase the MFI, or adding a base to raise the pH of the coalesced particles in order to decrease the MFI, until the desired and/or predetermined MFI is met.

For example, in order to determine if the MFI of the toner should be increased or decreased, the MFI of a sample of the coalesced particles may be measured. The MFI of a sample may then be compared to a predetermined MFI of the toner. The pH of the coalesced particles would then be adjusted in order to reach the desired MFI. For example, if the MFI of the sample is too high when compared to a predetermined target MFI, a base may be added to increase the pH, and thus lower the MFI of the coalesced toner particles.

Without being bound by theory, it is believed that a higher pH results in a lower amount of free H+ ions. The H+ ions react with other ions, for example, Al ions of the aggregating agent, so that the more free H+ ions there are (lower pH), the more other ions, for example, Al ions, are pulled out of the toner. This results in a higher MFI. Conversely, the less free H+ ions (higher pH), the less other ions, for example, Al ions, are pulled out of the toner, thus resulting in a lower MFI.

The Al ions in the aggregating agent form crosslinks between the latex polymer chains. The more Al ions, the higher the crosslinking and the lower the MFI and the higher the fusing temperature, the higher the blocking temperature, and the higher the offset temperature (Hot Offset). Conversely, the lower the Al ions, the lower the crosslinking and the higher the MFI and the lower the fusing temperature, the lower the blocking temperature, and the lower the offset temperature (cold offset).

The MFI of the toner is not the only parameter that is relevant for the fusing performance. Hardware parameters such as fuser roll material and operating temperature, fuser roll age, and machine speed are some parameters that are critical for fusing. For instance, one toner design that has acceptable fusing characteristics may have unacceptable performance in a similar machine operating at a different speed. The method described herein enables tailoring the MFI of a toner formulation to enable acceptable fusing performance in different machines operating under different conditions without having to change the formulation of the toner. Specifically, one can enable using the same toner formulation in different machines by adjusting the pH at the end of coalescence.

In addition, for a given toner composition, the relationship between the pH and the MFI can be readily measured and established, for example, as illustrated in FIG. 1. The determined relationship between the pH and MFI can be subsequently used to appropriately adjust the pH so that the desired MFI may be obtained.

After the pH adjustment to adjust the MFI, the mixture may then be cooled in a cooling or freezing step to less than the Tg and/or melting point of the particle.

The slurry may then be washed to remove surfactants.

Particles are then dried so that they have a moisture level below 1%.

Particles produced by the present disclosure may then be combined with other optional additives known in the art, for example, charge control agents, external surface additives, carriers and the like, to produce a toner composition.

The above-described method offers several advantages. First, by controlling the pH, the variability in MFI is reduced. Second, this method allows tailoring the MFI of the toner by a simple adjustment in pH instead of changing the properties of raw materials such as latex, which can be expensive, time consuming, and may lead to other unforeseen issues.

EXAMPLES

The following examples are for purposes of further illustrating the present disclosure.

13.4 kg of latex made by emulsion polymerization process with Mw of 55 k. and Tg of 55° C., was mixed with 2.08 kg of carbon black pigment dispersion, 4.17 kg wax dispersion and it was aggregated by the addition of 154 g of polyaluminium chloride until the desired size was achieved. 7.7 kg of latex shell was then added. After 30 min, NaOH was added to achieve a pH of 4.7, while the temperature was raised to 96° C. to coalesce particles. When the desired shape was achieved, the pH was adjusted to a pH of 7 (control) to halt coalescence. The pH was then further adjusted to the values listed in the Table 1 to change the MFI of the toner. The particles were cooled, washed and dried.

After coalescence, the pH of the mixture was adjusted to values ranging from 5.5 to 7.4. The toner was dried using a halogen moisture analyzer, for example, Mettler-Toledo Model HR-73 Halogen Moisture Analyzer. The MFI was then measured by a Melt flow Rheometer, for example, Tinius Olsen Model MP 987 Extrusion Plastometer, at a setting of 130° C. and 10 kg of weight. The results are shown in Table 1 and graphically in FIG. 1.

| Toner | MFI | pH After Adjustment |
|---|---|---|
| 1 | 6.6 | 7.42 |
| 2 | 14.3 | 5.55 |
| 3 (control) | 10.6 | 7 |
| 4 | 12.4 | 6 |
| 5 | 12.8 | 6.5 |

The results demonstrate a correlation between MFI and the pH target. As shown graphically in FIG. 1, a higher MFI is achieved when the pH is a lower value.

For a given toner composition, results like those above can be readily obtained as described herein and stored. The data can then be referenced when making individual batches/runs of additional toner of that composition so that it can be determined how much pH adjustment is required for a desired MFI adjustment of each individual batch/run.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

What is claimed is:

1. A method of adjusting the melt flow index of a toner comprising toner particles, the method comprising:
- measuring a melt flow index after a coalescing of the toner particles;
- comparing the measured melt flow index to a predetermined target melt flow index of the toner; and
- adjusting a pH of the toner to move the melt flow index toward the predetermined target.

2. The method of claim 1, wherein the toner particles are formed by an emulsion-aggregation process, wherein during the preparation of the emulsion, at least one surfactant was added during the preparation process, wherein the pH is adjusted after coalescing the toner particles, but before a removal of the at least one surfactant from a surface of the coalesced toner particles.

3. The method of claim 1, wherein the pH is adjusted at substantially the same temperature as a temperature for coalescing.

4. The method of claim 1, wherein the adjusting the pH comprises adding a base to the coalesced toner particles to raise a pH of the coalesced toner particles, thereby lowering the melt flow index of the toner.

5. The method of claim 1, wherein the adjusting the pH comprises measuring a pH of the coalesced toner particles, and adding an acid or a base in an amount that alters the measured pH.

6. A method comprising:
- aggregating a mixture comprising a latex resin and at least one colorant;
- coalescing the aggregated toner particles;
- measuring the melt flow index of the coalesced toner particles;
- comparing the measured melt flow index to a predetermined target melt flow index of the toner particles; and
- adjusting a pH of the coalesced toner particles to move the melt flow index toward the predetermined target.

7. The method of claim 6, wherein the adjusting the pH occurs at a temperature that is about +/−40° C. of a temperature of the coalescing.

8. The method of claim 7, wherein the pH adjustment occurs before the coalesced toner particles are cooled to less than a melting point of the particles.

9. The method of claim 6, wherein the adjusting the pH comprises adding a base to the coalesced toner particles to raise a pH of the coalesced toner particles, thereby lowering the melt flow index of the toner.

10. The method of claim 6, wherein the adjusting the pH comprises measuring a pH of the coalesced toner particles, and adding an acid or a base in an amount that alters the measured pH.

11. A process comprising:
- preparing an emulsion comprising at least one polymer;
- aggregating the emulsion with an aggregating agent to form aggregated particles;
- coalescing the aggregated particles to set a shape of the particles; and adjusting a pH of the coalesced particles, wherein
- the adjusting comprises measuring a pH of the coalesced toner particles, and adding an acid or a base in an amount that alters the measured pH to a corresponding predetermined melt flow index of the particles.

12. The process of claim 11, wherein the adjusting the pH occurs before the coalesced particles are cooled to less than a glass transition temperature of the particles.

13. The process of claim 11, wherein during the preparation of the emulsion, at least one surfactant is added to the emulsion, wherein the adjusting of the pH occurs after the coalescing, but before a subsequent removal of the at least one surfactant from a surface of the particle.

14. The process of claim 11, wherein the adjusting the pH comprises adding a base to the coalesced toner particles to raise a pH of the coalesced particles, thereby lowering the melt flow index of the particles.

15. The process of claim 11, wherein the at least one aggregating agent is selected from the group consisting of polyaluminum halides, polyaluminum silicates, water soluble metal salts, and combinations thereof.

16. A process comprising:
- preparing an emulsion comprising at least one polymer;
- aggregating the emulsion with an aggregating agent to form aggregated particles;
- coalescing the aggregated particles to set a shape of the particles;
- measuring a melt flow index of the coalesced particles;
- comparing the measured melt flow index to a predetermined target melt flow index of the particles; and
- adjusting a pH of the coalesced particles to move the melt flow index toward the predetermined target.

* * * * *